United States Patent [19]

Spanier

[11] 4,174,474

[45] Nov. 13, 1979

[54] ENDSWITCH CAM ARRANGEMENT

[75] Inventor: Hermann Spanier, Windhagen, Fed. Rep. of Germany

[73] Assignee: Dr. Boy K.G., Fernthal, Fed. Rep. of Germany

[21] Appl. No.: 901,146

[22] Filed: Apr. 28, 1978

[30] Foreign Application Priority Data

Apr. 28, 1977 [DE] Fed. Rep. of Germany ..... 2719066

[51] Int. Cl.[2] ..... H01H 3/20

[52] U.S. Cl. ..... 200/331

[58] Field of Search ..... 200/330, 331-332, 200/335, 337, 338, 18 R, 178, 5 A, 5 B, 5 C, 5 EA, 16 R, 153 LA

[56] References Cited

U.S. PATENT DOCUMENTS 2,968,710 4/1961 Horberg ..... 200/331

3,586,805 6/1971 Ziegler ..... 200/153 LA

*Primary Examiner*—Harry N. Haroian

*Attorney, Agent, or Firm*—Thomas E. Beall, Jr.

[57] ABSTRACT

To be used in operating one or more end switches, one or more cams are mounted on a switchbar, with each cam having two parts with angularly related surfaces that move towards and away from each other by means of a head screw so as to clamp against two correspondingly angled parts of the switchbar, to draw the cam transversely against the side of the switchbar. The switchbar is provided with a V-shaped groove, so as to provide two angled surface portions for respectively engaging two cams mounted respectively on opposite sides of the switchbar, so that the same may be moved past each other in the direction of elongation of the switchbar without interfering with each other.

14 Claims, 6 Drawing Figures

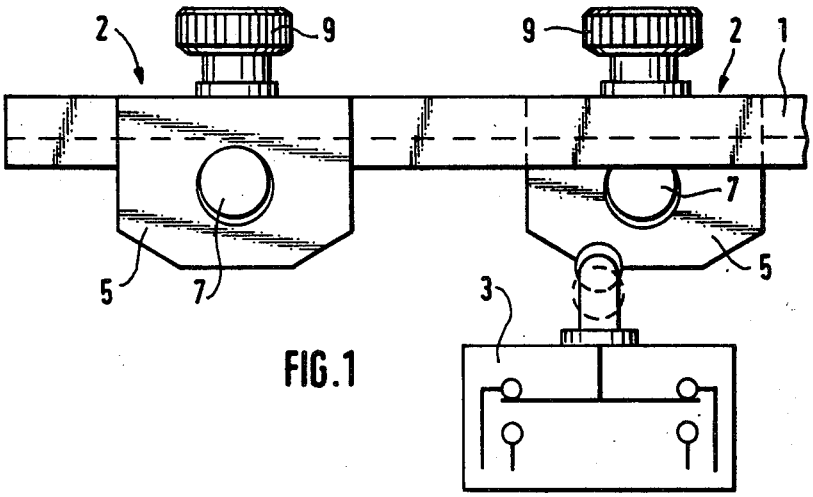
FIG. 1
FIG. 2
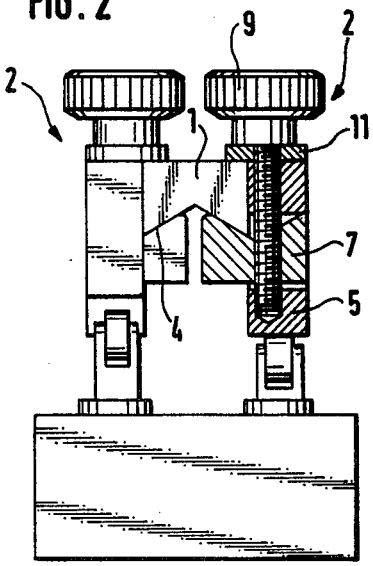

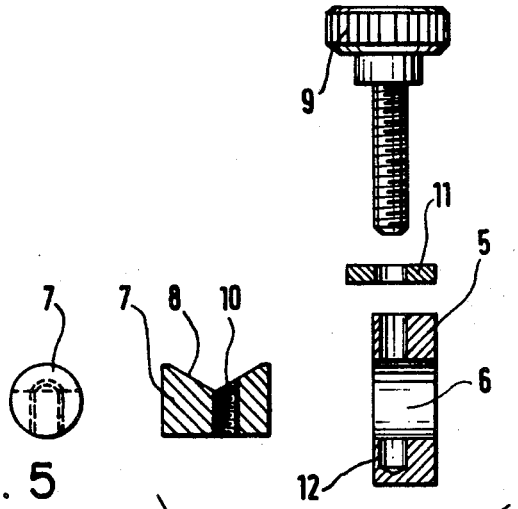
FIG. 5
FIG. 3
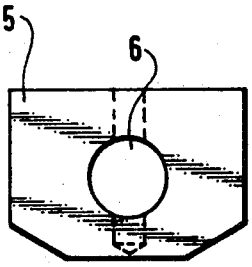
FIG. 6
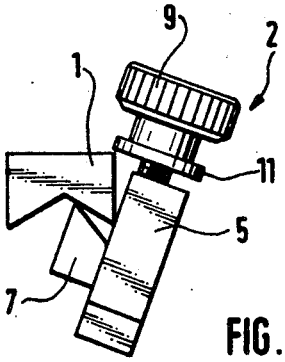
FIG. 4

ENDSWITCH CAM ARRANGEMENT

The invention relates to an endswitch cam arrangement having at least one adjustable cam mounted on a switchbar for operation of an endswitch belonging thereto.

Such arrangements are used in machine tools for limiting of feed, and especially in injection machines for the control of hydraulic drivers, for example for control of the injection unit. In such arrangements either the switchbar or the endswitch is held stationary, while the other part lies on the movable unit. The adjustment of the cam on the switchbar serves to adjust the stroke to the desired specifications.

Previously, switchbars with round cross-sections were used. This required that a relatively complex arrangement be used, because a separate switchbar was required for each cam.

The invention has the object to reduce the complexity of the prior art arrangements.

To attain this object, the endswitch cam arrangement according to the invention is characterized in that the switchbar has a profile forming a plurality of paths for the independent adjustment of the cams mounted thereon. Therefore, several cams can be arranged on a common switchbar and can be adjusted independently of each other along this switchbar, for example, to control several endswitches or several functions of a switch. With this arrangement, not only the complexity of construction decreases, but also the need of space.

Preferably, the switchbar is essentially rectangular, with a lengthwise, V-shaped groove running along one surface. In this way, a symmetrical profile results, which has two paths for cams belonging thereto; each path following one of the inclined surfaces of the groove. To prevent the cams from hindering one another, the apex of the groove is preferably maintained relatively flat and the edges of the groove are maintained as close as possible to a right angle to the edge of the profile.

According to a further advantageous feature, each cam comprises a body having a flat surface for mating with a rectangular wall of the switchbar, an inclined surface for mating with one wall of said V-shaped groove and an opposing surface, at a right angle to said flow cam body surface, for engaging the rectangular wall of the switchbar, wherein the distance between said inclined cam and said opposing surface is adjustable. The cam is therefore mounted on the switchbar such that the inclined surface engages the sloping surface of the V-shaped groove and the opposing surface pushes on the opposing profile surface of the switchbar. In this way, the cam "pulls" itself onto the switchbar profile until the side surface of the cam body lies against the side surface of the switchbar profile. The cam is held securely and in a defined position.

Preferably, the opposing surface comprises a head screw or its collar. Thus, the cam may be easily loosened and moved. Also, an especially advantageous feature lies in that the cam may be mounted and dismounted at the side of the switchbar at any location therealong. One need only loosen the headscrew far enough so that the cam can be moved out of its dovetail-like guiding position.

From the production standpoint, an especially advantageous construction of the cam is for the inclined surface of the cam to be formed by a cylindrical clamp jaw which is slidable into a borehole of the cam body and which carries in its outer surface a V-shaped groove and a bore for receiving a head screw passing through the cam body. The inclined surface can be easily produced on the outer surface of the cylindrical clamp jaw. The headscrew then serves to connect the clamp jaw to the cam body.

The invention is explained in detail with reference to the drawing, in which:

FIG. 1 shows a side view of a switchbar with two cams, and an endswitch;

FIG. 2 shows a partially cut-away front view of the arrangement of FIG. 1;

FIG. 3 shows an exploded view of the individual parts of the cam;

FIG. 4 shows the mounting of one of the cams onto the switchbar and

FIG. 5 shows an end view of the clamp jaw 7, taken perpendicular to FIG. 3; and

FIG. 6 shows an end view of the cam body 5, taken perpendicular to FIG. 3.

As to FIG. 1, the switchbar 1 carries two adjustable cams 2 for actuating an endswitch 3 which here is a double switch. It can be seen from FIG. 2 that the switchbar 1 has an essentially rectangular cross-section and possesses on its lower surface a V-shaped groove 4. Two independent cam paths result.

As shown in FIG. 3, each cam has a cam body 5 with a bore 6 for receiving a cylindrical clamp jaw 7. The clamp jaw 7 has on its outer surface a V-shaped groove 8, one side of which forms in assembled position an inclined surface for engaging one side of the V-shaped switchbar groove. A head screw 9, which extends through the cam body and is screwed into a threaded bore 10 of the clamp jaw, serves to connect clamp jaw 7 with the cam body. Further, a collar 11 is provided which, in mounted position, engages the upper profile surface of the switchbar 1. FIG. 2 shows clearly the resulting dove-tail guiding. The inclined surface of clamping jaw 7, which contacts the corresponding surface of the V-shaped switchbar groove, pulls the cam assembly into guiding position on the switchbar in cooperation with the opposing surface of collar 11, until the side surface 12 of cam body 5 contacts the corresponding profile surface of the switchbar. Preferably, both the cam body and the collar 11 contact the corresponding surfaces of the switchbar.

FIG. 4 shows the manner in which the cam assembly 2 can be readily mounted on or dismounted from the switchbar with a tipping movement.

I claim:

1. An endswitch cam arrangement having at least one adjustable cam mounted on a switchbar for operation of an end-switch belonging thereto, wherein said switchbar has a profile forming a plurality of paths for the independent adjustment of the cams mounted thereon, wherein the cross-sectional profile of said switchbar is essentially rectangular, with a lengthwise, V-shaped groove running along one surface, wherein each said cam comprises a cam body with a flat surface for mating with one wall of said switchbar, an inclined surface for mating with one wall of said V-shaped groove, and an opposing surface at a right angle to said flat cam body surface for engaging the rectangular wall of said switchbar, and wherein the distance between said inclined cam surface and said opposing surface is adjustable.

2. The apparatus according to claim 1, wherein said opposing surface comprises the collar of a head screw.

3. The apparatus according to claim 1, wherein said opposing surface comprises the head of a head screw.

4. The apparatus of claim 2 or 3, wherein the inclined surface of the cam is formed by a cylindrical clamping jaw which is slidable into a borehole of the cam body and which carries in its outer surface a V-shaped groove and a bore for receiving said head screw passing through the cam body.

5. An endswitch cam arrangement, comprising:

an elongated switchbar having a cross sectional shape transverse to its elongation that is uniform throughout its entire extent, the outer surfaces of said switchbar defining at least a first and second slide track which are laterally spaced from each other when viewed in the plane of said cross section, at least a first and second cam, said first cam being adjustabley mounted on said first slide track and said second cam being adjustably mounted on said second slide track, so as to permit movement of said cams past each other in the direction of elongation.

6. The apparatus according to claim 5, wherein:

said switch bar is defined by first opposed surfaces and second opposed surfaces, said first cam engaging only one of said first opposed surfaces and only the portions of each of said second opposed surfaces that are adjacent said one surface, and said second cam engaging only the other of said first opposed surfaces and only the portions of each of said second opposed surfaces that are adjacent said other surface.

7. An endswitch cam arrangement, comprising:

an elongated switchbar having a cross sectional shape transverse to its elongation that is uniform throughout its entire extent, and being defined by first opposed surfaces and second opposed surfaces;

at least a first and second cam adjustably mounted on said switchbar, said first cam engaging only one of said first opposed surfaces and only the portions of each of said second opposed surfaces that are adjacent said one surface, and said second cam engaging only the other of said first opposed surfaces and only the portions of each of said second opposed surfaces that are adjacent said other surface, so that said cams are laterally spaced from each other with respect to the direction of elongation of said switchbar when viewed in the plane of said cross section to permit movement of said cams past each other in the direction of elongation while said cams engage their respective surfaces of said switchbar.

8. The apparatus according to claim 7, wherein said adjacent surface portions of one of said second opposed surfaces that respectively engage said cams are angularly related to each other in cross section.

9. The apparatus of claim 8, wherein said angularly related adjacent surface portions form an outwardly opening V-shaped groove, and said cams have correspondingly angled surfaces for respectively engaging the two sides of said V-shaped groove.

10. The apparatus of any one of claims 7, 8, or 9 wherein each of said cams include two parts mounted with respect to each other for relative movement transverse to the elongation of said switchbar respectively toward and away from said opposed second surfaces, and means for moving said two parts toward and away from each other to respectively clamp and unclamp the cam on said switchbar.

11. The apparatus according to claim 7, wherein one of said parts comprises two components mounted for movement with respect to each other transversely of both the direction of elongation of said switchbar and the direction of relative movement of said two parts; said other part including said means for moving; said means for moving is a threaded fastener freely extending through one of said components and threaded into the other of said components; the one of said components having a transversely extending through aperture; and the other of said components having a basic, uniform cross sectional shape generally corresponding to but smaller than that of said aperture but with one side being further configured, as viewed in cross section transverse to said bar elongation, to be complementary to said adjacent portions of one of said second opposed surfaces of said switch bar.

12. The apparatus according to any one of claims 7, 8 or 9, further including at least one electrical switch having fixed and movable contacts, a cam follower movable transversely with respect to the elongation of said switch bar and operatively associated with said movable contacts for correspondingly moving said movable contacts into and out of engagement with said fixed contacts, and said cam follower being positioned with respect to at least one of said cams for engagement therebetween when said cam and cam follower are relatively moved rectilinear towards each other in the direction of elongation of said switch bar.

13. An endswitch cam arrangement, comprising:

an elongated switchbar having a cross sectional shape transverse to its elongation that is defined by first opposed surfaces and second opposed surfaces;

a cam adjustably mounted on said switchbar, said cam engaging only one of said first opposed surfaces and portions of each of said second opposed surfaces to permit movement of said cam in the direction of elongation while said cam engages its surfaces of said switchbar;

said surface portions of said second opposed surfaces that respectively engage said cam angularly related to each other in cross section so as to converge away from said one of said first opposed surfaces;

said cam including two parts having surfaces that are angularly related to each other complementary to and which respectively engage said second opposed surfaces;

said two parts being mounted with respect to each other for relative movement transverse to the elongation of said switchbar respectively toward and away from said opposed second surfaces;

and means for moving said two parts toward and away from each other to respectively clamp and unclamp the cam on said switchbar and move said cam against said one of said first opposed surfaces by wedging action of said angularly related surfaces.

14. The apparatus of claim 13, wherein one of said parts comprises two components mounted for movement with respect to each other transversely of both the direction of elongation of said switchbar and the direction of relative movement of said two parts; said other part including said means for moving; said means for moving is a threaded fastener freely extending through one of said components and threaded into the other of said components; the one of said components having a transversely extending through aperture; and the other of said components having a basic, uniform cross sectional shape generally corresponding to but smaller than that of said aperture but with one side being further configured as viewed in cross section transverse to said bar elongation, to be complementary to said adjacent portions of one of said second opposed surfaces of said switchbar.

* * * * *